US009458393B2

(12) United States Patent
Garcia, III

(10) Patent No.: US 9,458,393 B2
(45) Date of Patent: Oct. 4, 2016

(54) HYDANTOINS AS HYDROGEN SULFIDE AND MERCAPTAN SCAVENGERS

(71) Applicant: Ecolab USA Inc., Eagan, MN (US)

(72) Inventor: Juan M. Garcia, III, Sugar Land, TX (US)

(73) Assignee: Ecolab USA Inc., St. Paul, MN (US)

( * ) Notice: Subject to any disclaimer, the term of this patent is extended or adjusted under 35 U.S.C. 154(b) by 184 days.

(21) Appl. No.: 14/253,605

(22) Filed: Apr. 15, 2014

(65) Prior Publication Data

US 2015/0291890 A1 Oct. 15, 2015

(51) Int. Cl.
*C10G 29/20* (2006.01)
*C10G 21/12* (2006.01)

(52) U.S. Cl.
CPC ..... *C10G 29/20* (2013.01); *C10G 2300/202* (2013.01)

(58) Field of Classification Search
CPC ..... C10G 29/00; C10G 29/20; C10G 21/00; C10G 21/12; C10G 21/20; B01J 14/00; B01J 19/00; B01J 2222/40
See application file for complete search history.

(56) References Cited

U.S. PATENT DOCUMENTS

| | | | | |
|---|---|---|---|---|
| 4,189,587 | A | 2/1980 | Holt et al. | |
| 4,421,733 | A | 12/1983 | Blytas | |
| 4,569,766 | A | 2/1986 | Kool et al. | |
| 4,680,127 | A | 7/1987 | Edmondson | |
| 4,925,497 | A * | 5/1990 | Thierheimer, Jr. | C11D 3/43 106/311 |
| 5,128,049 | A | 7/1992 | Gatlin | |
| 5,225,103 | A | 7/1993 | Hoffmann et al. | |
| 5,488,103 | A | 1/1996 | Gatlin | |
| 5,674,377 | A | 10/1997 | Sullivan, III et al. | |
| 6,063,346 | A * | 5/2000 | Luna | B01D 53/1456 208/208 R |
| 6,887,447 | B2 | 5/2005 | Schield et al. | |
| 7,078,005 | B2 | 7/2006 | Smith et al. | |
| 7,216,710 | B2 | 5/2007 | Welton et al. | |
| 2002/0157989 | A1 | 10/2002 | Gatlin et al. | |
| 2003/0086814 | A1 | 5/2003 | Meyer | |
| 2004/0096382 | A1 | 5/2004 | Smith et al. | |
| 2007/0284288 | A1 | 12/2007 | Gatlin | |
| 2011/0315921 | A1 | 12/2011 | Ramachandran et al. | |
| 2012/0012507 | A1 | 1/2012 | Compton et al. | |
| 2014/0057817 | A1 | 2/2014 | Janak | |

FOREIGN PATENT DOCUMENTS

| | | | |
|---|---|---|---|
| EP | 0 279 667 | A2 | 8/1988 |
| EP | 0 882 778 | A2 | 9/1998 |
| EP | 1 363 985 | B1 | 8/2007 |
| EP | 2 465 975 | A1 | 6/2012 |
| WO | 02/051968 | A1 | 7/2002 |
| WO | 2012/128935 | A2 | 9/2012 |

OTHER PUBLICATIONS

Kelland, M. A., "Hydrogen Sulfide Scavengers," Production Chemicals for the Oil and Gas Industry, Chapter 15, 2009, pp. 363-376.

Kissel, C. L., et al., "Factors Contributing to the Ability of Acrolein to Scavenge Corrosive Hydrogen Sulfide," Society of Petroleum Engineers Journal, Oct. 1985, pp. 647-655.

International Search Report and Written Opinion issued for PCT/US2015/022789 dated Jun. 29, 2015, 12 pages.

* cited by examiner

*Primary Examiner* — Renee E Robinson
*Assistant Examiner* — Derek Mueller
(74) *Attorney, Agent, or Firm* — Senniger Powers LLP

(57) ABSTRACT

The present invention generally relates to compositions and methods for scavenging hydrogen sulfide and/or mercaptans from fluids. More particularly, the invention relates to the use of hydantoin compounds as a hydrogen sulfide or a mercaptan scavenger for hydrocarbon fluids, particularly for natural gas, crude oil, field oil, fuel oil, naphtha, gasoline, kerosene, diesel, slurry oil, gas oil, resid, refinery gas, coal gas, tar, asphalt, coke gas, ammonia synthesis gas, gas from a sulfurization plant, or industrial gas streams.

21 Claims, No Drawings

HYDANTOINS AS HYDROGEN SULFIDE AND MERCAPTAN SCAVENGERS

FIELD OF THE INVENTION

The present invention generally relates to compositions and methods for scavenging hydrogen sulfide and/or mercaptans from fluids. More particularly, the invention relates to the use of hydantoin compounds as a hydrogen sulfide or a mercaptan scavenger for hydrocarbon fluids, particularly for natural gas, crude oil, field oil, fuel oil, naphtha, gasoline, kerosene, diesel, slurry oil, gas oil, resid, refinery gas, coal gas, tar, asphalt, coke gas, ammonia synthesis gas, gas from a sulfurization plant, or industrial gas streams.

BACKGROUND OF THE INVENTION

Hydrogen sulfide is a toxic, corrosive, flammable gas that causes problems in both the upstream and downstream oil and gas industry. Exposure to this gas, even at low concentrations, can cause serious injury or death. Hydrogen sulfide ($H_2S$) in natural gas and crude oil reserves is often accompanied by small amounts of mercaptans (RSH), sulfides ($R_2S$), polysulfides, and carbonyl sulfide (COS). Considerable expense and effort are expended annually to reduce the $H_2S$ content of gas and oil streams to make them suitable for commercial use.

Hydrogen sulfide has an offensive odor, and natural gas and crude oil streams containing substantial amounts of $H_2S$ are considered "sour." In addition to natural gas and petroleum, there are also aqueous fluids that must be treated to reduce or remove $H_2S$, such as waste water streams. Treatments to reduce or remove $H_2S$ from hydrocarbon or aqueous streams are referred to as "sweetening" treatments because the odor of the processed products is improved by the absence of hydrogen sulfide. A chemical compound that is used to remove or reduce $H_2S$ levels sometimes is called a "scavenger" or "scavenging agent." Scavengers that react irreversibly with hydrogen sulfide or other sulfur species and convert them to a more inert form are considered nonregenerative.

In large production facilities, the most economical solution to remove $H_2S$ from a sour gas stream is to install a regenerative system. These systems typically employ a compound used in an absorption tower to contact the produced fluid and form weakly bound soluble salts which become unstable at elevated temperatures. The absorption compound, usually alkanolamines such as N-methyldiethanolamine (MDEA), and $H_2S$ are then regenerated by various means using heat, pressure reduction, or a combination thereof. The absorption material is reused in the system, and the separated $H_2S$ is treated by a modified Claus process to form elemental sulfur.

For hydrocarbon streams with small concentrations of hydrogen sulfide, the use of scavengers in batch treatments and continuous injection processes can provide a cost-effective alternative to conventional gas/liquid sweetening processes. Known hydrogen sulfide scavengers include solid scavengers (e.g. zinc-based or iron-based materials), oxidizing chemicals (e.g. chlorites, nitrites, bromates, iodates, and peroxides), aldehydes (e.g. formaldehyde, glutaraldehyde, acrolein, and glyoxal), reaction products of aldehydes and amines (e.g. triazines), metal carboxylates and other chelates, and other amine based products (e.g. amidines, maleimides, and amine oxides). (See Production Chemicals for the Oil and Gas Industry, CRC Press, 2010, Chapter 15, "Hydrogen Sulfide Scavengers," pg. 363-375).

Although the application of hydrogen sulfide scavengers is widely practiced in production and processing operations in the oil and gas industries, known scavengers have one or more limitations ranging from exorbitant prices to health, safety, and environmental problems. Thus, a continuing need exists for alternative hydrogen sulfide scavengers that overcome these deficiencies.

SUMMARY OF THE INVENTION

A method of reducing the amount of hydrogen sulfide or a mercaptan in a hydrocarbon fluid is provided.

One aspect of the invention is a method of reducing the amount of hydrogen sulfide or mercaptans in a hydrocarbon fluid. The method comprises contacting the hydrocarbon fluid with an effective amount of a composition comprising a compound of formula 1 having the structure:

(1)

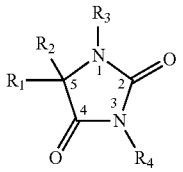

wherein $R_1$ and $R_2$ are independently hydrogen, alkyl, alkenyl, alkynyl, cycloalkyl, aryl, alkoxy or $R_1$ and $R_2$ together form $=CHR_5$; and $R_3$ and $R_4$ are independently hydrogen, alkyl, alkenyl, alkynyl, aryl, (cycloalkyl)alkyl, [(cycloalkyl)alkoxy]alkyl, (heterocycloalkyl)alkyl, [(heterocycloalkyl)alkoxy]alkyl, (alkylamino)alkyl, (dialkylamino)alkyl, (cycloalkylamino)alkyl, (dicycloalkylamino)alkyl, (arylamino)alkyl, (diarylamino)alkyl, (heteroarylamino)alkyl, (diheteroarylamino)alkyl, alkoxyalkyl, alkenoxyalkyl, or alkynoxyalkyl; $R_5$ is hydrogen, alkyl, alkenylaryl, phenyl, furyl, pyrrolyl, pyridyl, or indolyl; wherein at least one of $R_3$ and $R_4$ is other than hydrogen.

Other objects and features will be in part apparent and in part pointed out hereinafter.

DESCRIPTION OF THE PREFERRED EMBODIMENTS

New hydrogen sulfide and mercaptan scavengers as disclosed herein provide effective reduction of hydrogen sulfides and mercaptans with minimal health, environmental, and safety issues. Thus, the scavengers provide an effective alternative to commercial scavengers.

One aspect of the present invention is a method of reducing the amount of hydrogen sulfide or a mercaptan in a hydrocarbon fluid. The method comprises contacting the hydrocarbon fluid with an effective amount of a scavenger composition comprising a compound of formula 1 having the structure:

(1)

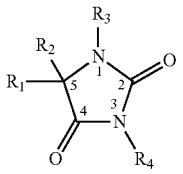

wherein $R_1$ and $R_2$ are independently hydrogen, alkyl, alkenyl, alkynyl, cycloalkyl, aryl, alkoxy or $R_1$ and $R_2$ together form $=CHR_5$; and $R_3$ and $R_4$ are independently hydrogen, alkyl, alkenyl, alkynyl, aryl, (cycloalkyl)alkyl, [(cycloalkyl)alkoxy]alkyl, (heterocycloalkyl)alkyl, [(heterocycloalkyl)alkoxy]alkyl, (alkylamino)alkyl, (dialkylamino)alkyl, (cycloalkylamino)alkyl, (dicycloalkylamino)alkyl, (arylamino)alkyl, (diarylamino)alkyl, (heteroarylamino)alkyl, (diheteroarylamino)alkyl, alkoxyalkyl, alkenoxyalkyl, or alkynoxyalkyl; $R_5$ is hydrogen, alkyl, alkenylaryl, phenyl, furyl, pyrrolyl, pyridyl, or indolyl; wherein at least one of $R_3$ and $R_4$ is other than hydrogen.

The method can also be practiced using the compound of formula 1, wherein $R_1$ and $R_2$ are independently hydrogen, $C_1$-$C_6$ alkyl, $C_2$-$C_6$ alkenyl, $C_2$-$C_6$ alkynyl, $C_3$-$C_6$ cycloalkyl, phenyl, tolyl, xylyl, naphthyl, or $C_1$-$C_6$ alkoxy. Preferably, $R_1$ and $R_2$ are independently hydrogen or $C_1$-$C_6$ alkyl. More preferably, $R_1$ and $R_2$ are independently hydrogen or methyl.

The method can further be practiced using the compound of formula 1, wherein at least one of $R_3$ and $R_4$ is alkyl, alkenyl, alkynyl, aryl, (alkylamino)alkyl, (dialkylamino)alkyl, alkoxyalkyl, alkenoxyalkyl, alkynoxyalkyl, (arylamino)alkyl, or (diarylamino)alkyl, wherein alkyl is $C_1$-$C_6$ alkyl, alkenyl is $C_2$-$C_6$ alkenyl, alkynyl is $C_2$-$C_6$ alkynyl, alkoxy is $C_1$-$C_6$ alkoxy, alkenoxy is $C_2$-$C_6$ alkenoxy, alkynoxy is $C_2$-$C_6$ alkynoxy, and aryl is phenyl, tolyl, xylyl, or naphthyl. Preferably, the compound of formula 1 has at least one of $R_3$ and $R_4$ as (cycloalkyl)alkyl, [(cycloalkyl)alkoxy]alkyl, (cycloalkylamino)alkyl, or (dicycloalkylamino)alkyl, wherein alkyl is $C_1$-$C_6$ alkyl, alkoxy is $C_1$-$C_6$ alkoxy, and cycloalkyl is $C_3$-$C_6$ alkyl. More preferably, the compound of formula 1 has at least one of $R_3$ and $R_4$ is (heterocycloalkyl)alkyl or [(heterocycloalkyl)alkoxy]alkyl, wherein heterocycloalkyl is oxiranyl, aziridinyl, oxetanyl, tetrahydrofuranyl, pyrrolidinyl, piperidinyl, dioxanyl, or morpholino, and wherein alkyl is $C_1$-$C_6$ alkyl, and alkoxy is $C_1$-$C_6$ alkoxy. Most preferably, the compound of formula 1 has at least one of $R_3$ and $R_4$ is (heteroarylamino)alkyl or (diheteroarylamino)alkyl, wherein heteroaryl is furanyl, pyrrolyl, pyranyl, pyridinyl, imidazolyl, pyrimidinyl, isoxazolyl, or oxazolyl, and alkyl is $C_1$-$C_6$ alkyl.

The compound of formula 1 can be, for example, a 1-[(oxiranylalkoxy)alkyl]hydantoin, 3-[(oxiranylalkoxy)alkyl]hydantoin, 1,3-bis[(oxiranylalkoxy)alkyl]hydantoin, 1-[(oxiranylalkoxy)alkyl]-5,5-dialkyl-hydantoin, 3-[(oxiranylalkoxy)alkyl]-5,5-dialkyl-hydantoin, 1,3-bis[(oxiranylalkoxy)alkyl]-5,5-dialkyl-hydantoin, 1-(dibutylaminoalkyl)hydantoin, 3-(dibutylaminoalkyl)hydantoin, 1,3-bis(dibutylaminoalkyl)hydantoin, 1-(dibutylaminoalkyl)-5,5-dialkyl-hydantoin, 3-(dibutylaminoalkyl)-5,5-dialkyl-hydantoin, 1,3-bis(dibutylaminoalkyl)-5,5-dialkyl-hydantoin, 1-(anilinoalkyl)hydantoin, 3-(anilinoalkyl)hydantoin, 1,3-bis(anilinoalkyl)hydantoin, 1-(anilinoalkyl)-5,5-dialkyl-hydantoin, 3-(anilinoalkyl)-5,5-dialkyl-hydantoin, 1,3-bis(anilinoalkyl)-5,5-dialkyl-hydantoin, 1-(morpholinoalkyl)hydantoin, 3-(morpholinoalkyl)hydantoin, 1,3-bis(morpholinoalkyl)hydantoin, 1-(morpholinoalkyl)-5,5-dialkyl-hydantoin, 3-(morpholinoalkyl)-5,5-dialkyl-hydantoin, 1,3-bis(morpholinoalkyl)-5,5-dialkyl-hydantoin, 1-(oxiranylalkyl)hydantoin, 3-(oxiranylalkyl)hydantoin, 1,3-bis(oxiranylalkyl)hydantoin, 1-(oxiranylalkyl)-5,5-dialkyl-hydantoin, 3-(oxiranylalkyl)-5,5-dialkyl-hydantoin, 1,3-bis(oxiranylalkyl)-5,5-dialkyl-hydantoin, 1-(alkoxyalkyl)hydantoin, 3-(alkoxyalkyl)hydantoin, 1,3-bis(alkoxyalkyl)hydantoin, 1-(alkoxyalkyl)-5,5-dialkyl-hydantoin, 3-(alkoxyalkyl)-5,5-dialkyl-hydantoin, 1,3-bis(alkoxyalkyl)-5,5-dialkyl-hydantoin, 1-(allyloxyalkyl)hydantoin, 3-(allyloxyalkyl)hydantoin, 1,3-bis(allyloxyalkyl)hydantoin, 1-(allyloxyalkyl)-5,5-dialkyl-hydantoin, 3-(allyloxyalkyl)-5,5-dialkyl-hydantoin, 1,3-bis(allyloxyalkyl)-5,5-dialkyl-hydantoin, 1-(propargyloxyalkyl)hydantoin, 3-(propargyloxyalkyl)hydantoin, 1,3-bis(propargyloxyalkyl)hydantoin, 1-(propargyloxyalkyl)-5,5-dialkyl-hydantoin, 3-(propargyloxyalkyl)-5,5-dialkyl-hydantoin, or 1,3-bis(propargyloxyalkyl)-5,5-dialkyl-hydantoin.

More specifically, the compound of formula 1 can be 1-[(oxiranylmethoxy)methyl]hydantoin, 3-[(oxiranylmethoxy)methyl]hydantoin, 1,3-bis[(oxiranylmethoxy)methyl]hydantoin, 1-[(oxiranylmethoxy)methyl]-5,5-dimethyl-hydantoin, 3-[(oxiranylmethoxy)methyl]-5,5-dimethyl-hydantoin, 1,3-bis[(oxiranylmethoxy)methyl]-5,5-dimethyl-hydantoin, 1-(dibutylaminomethyl)hydantoin, 3-(dibutylaminomethyl)hydantoin, 1,3-bis(dibutylaminomethyl)hydantoin, 1-(dibutylaminomethyl)-5,5-dimethyl-hydantoin, 3-(dibutylaminomethyl)-5,5-dimethyl-hydantoin, 1,3-bis(dibutylaminomethyl)-5,5-dimethyl-hydantoin, 1-(anilinomethyl)hydantoin, 3-(anilinomethyl)hydantoin, 1,3-bis(anilinomethyl)hydantoin, 1-(anilinomethyl)-5,5-dimethyl-hydantoin, 3-(anilinomethyl)-5,5-dimethyl-hydantoin, 1,3-bis(anilinomethyl)-5,5-dimethyl-hydantoin, 1-(morpholinomethyl)hydantoin, 3-(morpholinomethyl)hydantoin, 1,3-bis(morpholinomethyl)hydantoin, 1-(morpholinomethyl)-5,5-dimethyl-hydantoin, 3-(morpholinomethyl)-5,5-dimethyl-hydantoin, 1,3-bis(morpholinomethyl)-5,5-dimethyl-hydantoin, 1-(oxiranylmethyl)hydantoin, 3-(oxiranylmethyl)hydantoin, 1,3-bis(oxiranylmethyl)hydantoin, 1-(oxiranylmethyl)-5,5-dimethyl-hydantoin, 3-(oxiranylmethyl)-5,5-dimethyl-hydantoin, 1,3-bis(oxiranylmethyl)-5,5-dimethyl-hydantoin, 1-(methoxymethyl)hydantoin, 3-(methoxymethyl)hydantoin, 1,3-bis(methoxymethyl)hydantoin, 1-(methoxymethyl)-5,5-dimethyl-hydantoin, 3-(methoxymethyl)-5,5-dimethyl-hydantoin, 1,3-bis(methoxymethyl)-5,5-dimethyl-hydantoin, 1-(ethoxymethyl)hydantoin, 3-(ethoxymethyl)hydantoin, 1,3-bis(ethoxymethyl)hydantoin, 1-(ethoxymethyl)-5,5-dimethyl-hydantoin, 3-(ethoxymethyl)-5,5-dimethyl-hydantoin, 1,3-bis(ethoxymethyl)-5,5-dimethyl-hydantoin, 1-(propoxymethyl)hydantoin, 3-(propoxymethyl)hydantoin, 1,3-bis(propoxymethyl)hydantoin, 1-(propoxymethyl)-5,5-dimethyl-hydantoin, 3-(propoxymethyl)-5,5-dimethyl-hydantoin, 1,3-bis(propoxymethyl)-5,5-dimethyl-hydantoin, 1-(allyloxymethyl)hydantoin, 3-(allyloxymethyl)hydantoin, 1,3-bis(allyloxymethyl)hydantoin, 1-(allyloxymethyl)-5,5-dimethyl-hydantoin, 3-(allyloxymethyl)-5,5-dimethyl-hydantoin, 1,3-bis(allyloxymethyl)-5,5-dimethyl-hydantoin, 1-(propargyloxymethyl)hydantoin, 3-(propargyloxymethyl)hydantoin, 1,3-bis(propargyloxymethyl)hydantoin, 1-(propargyloxymethyl)-5,5-dimethyl-hydantoin 3-(propargyloxymethyl)-5,5-dimethyl-hydantoin, or 1,3-bis(propargyloxymethyl)-5,5-dimethyl-hydantoin.

The methods of the invention can be used to reduce hydrogen sulfide or mercaptans in a hydrocarbon fluid that is a liquid or a gas. When the hydrocarbon fluid is a liquid, the liquid is crude oil, field oil, asphalt, fuel oil, naphtha, gasoline, kerosene, or diesel. Preferably, the hydrocarbon liquid is crude oil.

When the hydrocarbon fluid is a gas, the gas can be natural gas, refinery gas, coal gas, coke gas, ammonia synthesis gas, gas from a sulfurization plant, or an industrial gas stream.

The amount of the scavenger composition used will depend on the amount of hydrogen sulfide and/or mercaptan in the hydrocarbon fluid being treated. In general, the amount of the scavenger composition added to the medium is at least an effective scavenging amount. Typically, the effective amount of the scavenger composition contains from about 0.1 ppm to about 10,000 ppm of a compound of Formula 1 in the hydrocarbon fluid. Preferably, the effective amount of Formula 1 is from about 1 ppm to about 10,000 ppm in the hydrocarbon fluid.

The total feed rate of the hydrogen sulfide scavenger will generally be determined by the operator of the specific production process including the scavenging treatment. Those of ordinary skill in the art operating such a process will know how to determine the specific operating parameters of their unit. The effective amount of the hydrogen sulfide scavenger can be adjusted in the field based on the concentration of hydrogen sulfide or mercaptans present in the hydrocarbon fluid to be treated.

The methods can further comprise storing the hydrocarbon fluid in a storage tank, rail car, tank truck, or pipeline after it is contacted with the composition. Preferably, the hydrocarbon fluid is stored in a storage tank.

The scavenger composition is injected into, or otherwise brought into contact with, the hydrocarbon fluid in any convenient manner. For example, the scavenger composition may be injected into the hydrocarbon fluid upstream of a refining unit as the fluid passes through a turbulent section of piping. Also, the scavenger composition can be admixed with a hydrocarbon fluid in a holding vessel that is agitated. Further, the scavenger composition can be admixed with the hydrocarbon fluid immediately upstream of a refining unit by injecting it into a turbulent flow. Still further, the scavenger composition can be atomized and added to a vaporous hydrocarbon stream using, for example, an injection quill.

The methods can be performed wherein the scavenger composition is contacted with the hydrocarbon fluid by injecting the composition into a run-down line for the hydrocarbon fluid. The scavenger composition can also be injected into hydrocarbon fluid using a bubble tower contactor. The scavenger composition can be injected as part of a continuous or batch process.

The methods can also include contacting the scavenger composition with the hydrocarbon fluid by injecting the composition into a storage tank with mixing.

The scavenger composition used can include the compounds of Formula 1 neat or diluted with a solvent, and may be formulated with other suitable materials or additives, such as dispersants and corrosion inhibitors. For liquid systems, suitable solvents for dissolving the compounds include polar and nonpolar solvents. Preferred solvents include methanol, heavy aromatic naphtha, light aromatic naphtha, 2-ethylhexanol, or a combination thereof. The amount of solvent used is typically limited to the minimum amount necessary to place the scavenger compound of Formula 1 in an easy-to handle, liquid form.

The compounds of Formula 1 can have a wide variety of concentrations in the scavenger composition. The compounds can be used with or without a solvent. When a solvent is used, the compound of Formula 1 can be present at a concentration of from about 5 wt. % to about 95 wt. % and preferably, from 35 wt. % to about 85 wt. %.

The scavenger composition can consist essentially of or consist of the compound of Formula 1.

The scavenger composition can also be used in applications outside of a refining process. For example, when the application to be treated is an oil well, the scavenger composition can be introduced downhole or into the above ground equipment. The scavenger composition can also be introduced into pipelines, storage vessels, and mobile vessels such as trucks, rail cars, and ship cargo holds. The scavenger compositions can be actively or passively mixed with the hydrocarbon fluid being treated.

The temperature at which the scavenger is contacted with the hydrocarbon stream may be between about 20° C. and 290° C. More preferably, the temperature is between about 20° C. and 180° C.

Another aspect of the present invention is a method of reducing the amount of hydrogen sulfide or a mercaptan in an aqueous fluid having a high concentration of hydrogen sulfide or mercaptans. The method comprises contacting a scavenger composition with the aqueous fluid. The aqueous fluid can include an aqueous stream of a water injection system, waste water associated with a hydrocarbon treatment system, a waste water stream in transit to or from a wastewater treatment facility, or waste water from a tanning facility.

The compounds of Formula 1 can be prepared using the following reaction schemes. First, a hydroxyalkyl substituted hydantoin intermediate is prepared. For example, the hydroxyalkyl substituted hydantoin intermediates can be prepared as follows:

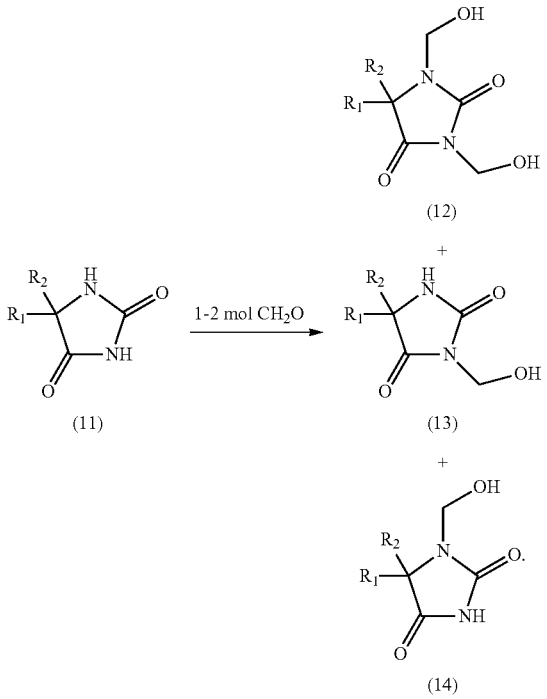

For compounds 11 through 14, $R_1$ and $R_2$ are as defined in connection with Formula 1.

Synthesis of the hydantoins of interest are carried out stepwise to produce the 1,3-bis(dimethylol) hydantoin derivative without isolating the intermediate. The first step is the condensation reaction of the base hydantoin (97% 5,5-dimethyl hydantoin or 98% hydantoin) with formalin at ambient temperature. When possible, the condensation reaction is conducted at ambient temperature to prevent polymer formation presumably leading to polymethylene hydantoin.

Further, the aminoalkyl substituted hydantoins of Formula 1 can be prepared according to the following reaction scheme:

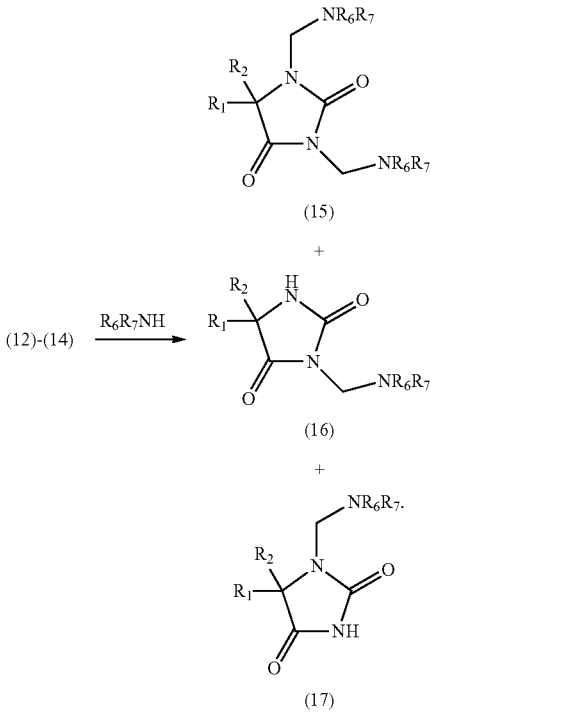

For compounds 15 through 17, $R_1$ and $R_2$ are as defined in connection with Formula 1, $R_6$ and $R_7$ are independently hydrogen, alkyl, phenyl, or together with the nitrogen atom of the amine (i.e., $R_6R_7NH$) form a morpholino group, wherein at least one of $R_6$ and $R_7$ is hydrogen.

The reaction between 1-(hydroxymethyl)-substituted or unsubstituted hydantoin, 3-(hydroxymethyl)-substituted or unsubstituted hydantoin, or 1,3-bis(hydroxymethyl)-substituted or unsubstituted hydantoin and an amine is carried out yielding the 1-aminoalkyl-substituted or unsubstituted hydantoin, 3-aminoalkyl-substituted or unsubstituted hydantoin, or 1,3-bis(aminoalkyl)-substituted or unsubstituted hydantoin.

Additionally, the (oxiranylalkoxy)alkyl substituted hydantoins of Formula 1 can be prepared as follows:

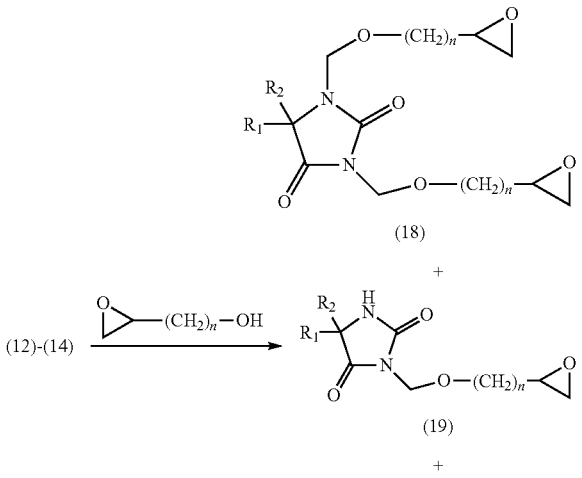

-continued

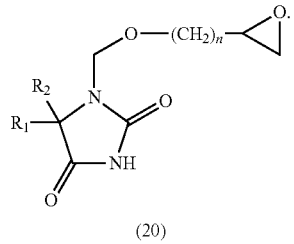

For compounds 18 through 20, $R_1$ and $R_2$ are as defined in connection with Formula 1 and n is 1-6.

The oxiranylalkyl substituted hydantoins of Formula 1 can be prepared according to the following reaction scheme:

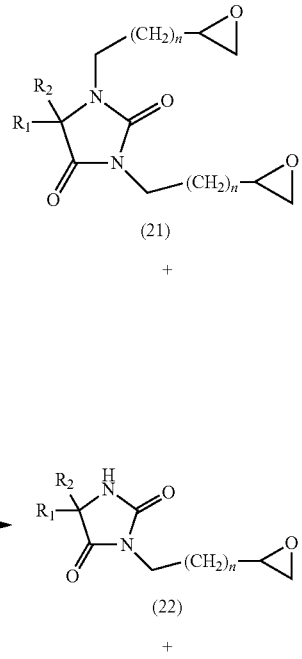

For compounds 21 through 23, $R_1$ and $R_2$ are as defined in connection with Formula 1 and n is 0-6.

Further, the alkoxyalkyl substituted hydantoins of Formula 1 can be prepared according to the following reaction scheme:

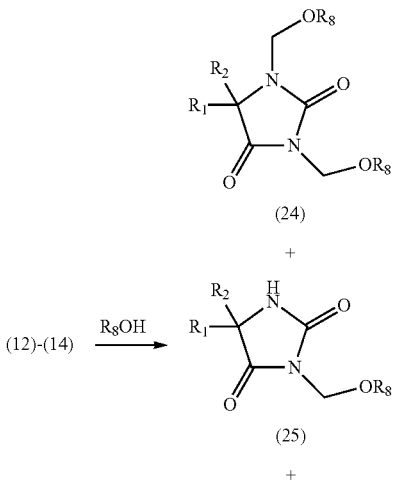

-continued

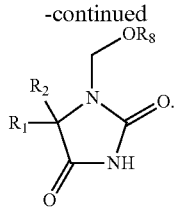

For compounds 24 through 26, $R_1$ and $R_2$ are as defined in connection with Formula 1 and $R_8$ is alkyl, alkenyl, or alkynyl. Preferably, $R_8$ is methyl, ethyl, propyl, allyl, or propargyl.

The reaction between 1-(hydroxymethyl)-substituted or unsubstituted hydantoin, 3-(hydroxymethyl)-substituted or unsubstituted hydantoin, or 1,3-bis(hydroxymethyl)-substituted or unsubstituted hydantoin with an alkanol lead to the condensation reaction products formed between the intermediate and the primary alcohol respectively yielding 1-(alkoxymethyl)-substituted or unsubstituted hydantoin, 3-(alkoxymethyl)-substituted or unsubstituted hydantoin, or 1,3-bis(alkoxymethyl)-substituted or unsubstituted hydantoin.

The 3-vinyl hydantoins can be prepared by methods described in various articles including RE: M. Sato, "Hydantoin and Acrylonitrile", Nippon Kagaku Azssi, V83 n3 (1962) 318-323; M. Sato, "Hydantoin and Vinyl Ethers and Acetates", Nippon Kagaku Azssi, V83 n3 (1962) 323-327; and J. W. Shaffer, et al., "Substitution in the Hydantoin Ring. VII. N-3-Propionic acid and Its Ethyl Ester and N-3-(2-Cyanoethyl) Derivatives, J. Med. Chem. 11(3), 462 (1968). These compounds can be prepared according to the following reaction scheme:

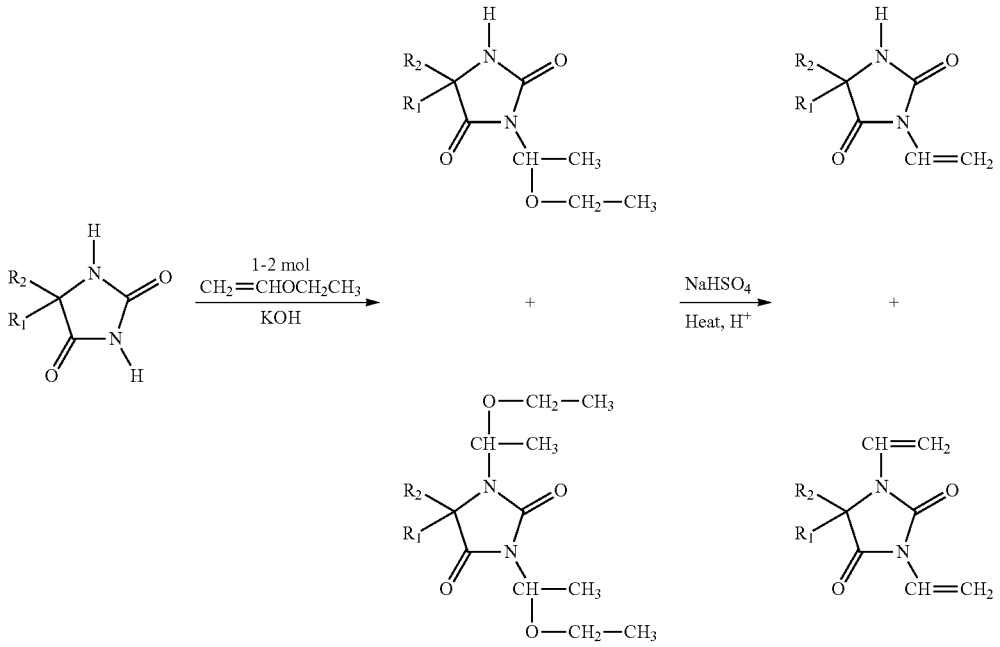

wherein $R_1$ and $R_2$ are as defined in connection with Formula 1. Preferably, $R_1$ and $R_2$ are independently hydrogen or methyl.

The compounds of Formula 1 wherein $R_1$ and $R_2$ together form $=CHR_5$ can be prepared according to the processes described in U.S. Pat. No. 2,861,079 (Britton et al.), which is incorporated herein by reference with respect to the compound synthesis process.

"Hydrocarbon fluid" means a liquid, gas, or mixture thereof that predominantly comprises aliphatic and/or aromatic hydrocarbons. The hydrocarbon fluid may be crude, partially refined, or fully refined. The hydrocarbon fluid of the present invention includes, but is not limited to, natural gas, crude oil, field oil, fuel oil, naphtha, gasoline, kerosene, diesel, slurry oil, gas oil, resid, refinery gas, coal gas, tar, asphalt, coke gas, ammonia synthesis gas, gas from a sulfurization plant, or an industrial gas stream.

Unless otherwise indicated, an alkyl group as described herein alone or as part of another group is an optionally substituted linear saturated monovalent hydrocarbon substituent containing from one to sixty carbon atoms and preferably one to thirty carbon atoms in the main chain or eight to thirty carbon atoms in the main chain, or an optionally substituted branched saturated monovalent hydrocarbon substituent containing three to sixty carbon atoms, and preferably eight to thirty carbon atoms in the main chain. Examples of unsubstituted alkyl groups include methyl, ethyl, n-propyl, i-propyl, n-butyl, i-butyl, s-butyl, t-butyl, n-pentyl, i-pentyl, s-pentyl, t-pentyl, and the like.

Unless otherwise indicated, the alkenyl groups described herein are preferably lower alkenyl containing from two to thirty carbon atoms in the principal chain and up to 60 carbon atoms. They may be straight or branched chain or cyclic and include ethenyl, propenyl, isopropenyl, butenyl, isobutenyl, hexenyl, and the like.

Unless otherwise indicated, the alkynyl groups described herein are preferably lower alkynyl containing from two to 30 carbon atoms in the principal chain and up to 60 carbon atoms. They may be straight or branched chain and include ethynyl, propynyl, butynyl, isobutynyl, hexynyl, and the like.

The terms "aryl" or "ar" as used herein alone or as part of another group (e.g., aralkyl) denote optionally substituted homocyclic aromatic groups, preferably monocyclic or bicyclic groups containing from 6 to 12 carbons in the ring portion, such as phenyl, biphenyl, naphthyl, substituted phenyl, substituted biphenyl or substituted naphthyl. Phenyl and substituted phenyl are the more preferred aryl. The term "aryl" also includes heteroaryl.

The terms "halogen" or "halo" as used herein alone or as part of another group refer to chlorine, bromine, fluorine, and iodine.

The term "-ene" as used as a suffix as part of another group denotes a bivalent substituent in which a hydrogen atom is removed from each of two terminal carbons of the group, or if the group is cyclic, from each of two different carbon atoms in the ring. For example, alkylene denotes a bivalent alkyl group such as methylene (—$CH_2$—) or ethylene (—$CH_2CH_2$—), and arylene denotes a bivalent aryl group such as o-phenylene, m-phenylene, or p-phenylene.

The term "alkoxy," as used herein alone or as part of another group, denotes an optionally substituted group having the structure —OR, wherein R is alkyl, alkenyl, or alkynyl as described herein.

The term "heteroaryl," as used herein alone or as part of another group, denotes an optionally substituted monovalent monocyclic or bicyclic aromatic radical of 5 to 10 ring atoms in protonated or unprotonated form, where one or more, preferably one, two, or three, ring atoms are heteroatoms independently selected from N, O, and S, and the remaining ring atoms are carbon. Exemplary heteroaryl moieties include benzofuranyl, benzo[d]thiazolyl, benzo[d]thiazolium, isoquinolinyl, isoquinolinium, quinolinyl, quinolinium, thiophenyl, imidazolyl, imidazolium, oxazolyl, oxazolium, furanyl, thiazolyl, thiazolium, pyridinyl, pyridinium, furyl, thienyl, pyridyl, pyrrolyl, pyrrolidinium, indolyl, indolinium, and the like.

The term "heterocyclo," as used herein alone or as part of another group, denotes a saturated or unsaturated monovalent monocyclic group of 4 to 8 ring atoms in protonated or unprotonated form, in which one or two ring atoms are heteroatom(s), independently selected from N, O, and S, and the remaining ring atoms are carbon atoms. Additionally, the heterocyclic ring may be fused to a phenyl or heteroaryl ring, provided that the entire heterocyclic ring is not completely aromatic. Exemplary heterocyclo groups include the heteroaryl groups described above, pyrrolidino, pyrrolidinium, piperidino, piperidinium, morpholino, morpholinium, piperazino, piperazinium, succinimide, and the like. In some cases, the heterocyclo can be a bivalent radical wherein the hydrogen is removed from each of two atoms in the heterocyclo group.

The term "hydrocarbon" as used herein describes a compound or substituent consisting exclusively of the elements carbon and hydrogen.

The term "substituted" as in "substituted aryl," "substituted alkyl," and the like, means that in the group in question (i.e., the alkyl, aryl or other group that follows the term), at least one hydrogen atom bound to a carbon atom is replaced with one or more substituent groups such as hydroxy (—OH), alkylthio, phosphino, amido (—$CON(R_A)(R_B)$, wherein $R_A$ and $R_B$ are independently hydrogen, alkyl, or aryl), amino(—$N(R_A)(R_B)$, wherein $R_A$ and $R_B$ are independently hydrogen, alkyl, or aryl), halo (fluoro, chloro, bromo, or iodo), silyl, nitro (—$NO_2$), an ether (—$OR_A$ wherein $R_A$ is alkyl or aryl), an ester (—$OC(O)R_A$ wherein $R_A$ is alkyl or aryl), keto (—$C(O)R_A$ wherein $R_A$ is alkyl or aryl), heterocyclo, and the like. When the term "substituted" introduces a list of possible substituted groups, it is intended that the term apply to every member of that group. That is, the phrase "optionally substituted alkyl or aryl" is to be interpreted as "optionally substituted alkyl or optionally substituted aryl."

"Arylalkyl" or "aralkyl" means an aryl group attached to the parent molecule through an alkylene group. The number of carbon atoms in the aryl group and the alkylene group is selected such that there is a total of about 6 to about 18 carbon atoms in the arylalkyl group. A preferred arylalkyl group is benzyl.

Having described the invention in detail, it will be apparent that modifications and variations are possible without departing from the scope of the invention defined in the appended claims.

EXAMPLES

The following non-limiting examples are provided to further illustrate the present invention.

Example 1A

Synthesis of 1,3-Bis(dibutylaminomethyl)-5,5-dimethyl Hydantoin 5,5-Dimethyl hydantoin (46.84 g, 0.35 moles) was dissolved in 25 g of deionized water and 57.48 g of formalin (0.71 moles) at 25° C. The solution was stirred for one hour to ensure all of the hydantoin was dissolved. Dibutylamine (92.45 g, 0.71 moles) was added dropwise with continued mixing of the aqueous phase. The mixture was slowly heated to a target temperature of 60° C., which was maintained for an additional 30 minutes once the last of the amine was charged to the reaction vessel. The reaction mixture was then allowed to cool to room temperature with continued stirring. Once cooled, stirring of the solution was stopped allowing the organic layer to separate from the aqueous phase and allowing for recovery of the oil soluble scavenging compound.

Example 1B

Alternate Synthesis of 1,3-Bis(dibutylaminomethyl)-5,5-dimethyl Hydantoin 5,5-Dimethyl hydantoin (48.21 g, 0.36 moles) was dissolved in 50 g of deionized water at 20° C. While stirring the aqueous mixture, 59.24 g of formalin (0.73 moles) was charged dropwise to the reaction vessel while increasing the temperature to 25° C. The solution was stirred for 2 hours to ensure all of the hydantoin was dissolved. The temperature of the mixture was increased to 30° C. and dibutylamine (94.81 g, 0.73 moles) was charged dropwise into the reaction mixture. Dibutylamine was added over the course of 40 minutes, while the temperature was slowly raised to a target temperature of 60° C., which was maintained for an additional 60 minutes after the last drop of amine was charged to the reaction vessel. The reaction mixture was then allowed to cool to room temperature with continued stirring. Once the solution had cooled, the stirring of the solution was stopped enabling the organic layer to separate from the aqueous phase allowing for the recovery of the oil soluble scavenging compound.

Example 2

Synthesis of 1,3-Bis(methoxypropyl)-5,5-dimethyl Hydantoin 5,5-Dimethyl hydantoin (48.87 g, 0.37 moles) was dissolved in 25 g of deionized water and 60.10 g of formalin (0.74 moles) at 20° C. The temperature of the mixture was increased to 35° C. and stirred for one hour to ensure all of the hydantoin was dissolved. After allowing the mixture to cool to 20° C., 1-propanol (44.69 g, 0.74 moles) was charged dropwise to the reaction mixture over the course of 15 minutes. The solution was stirred for an additional two hours while slowly increasing the temperature from 20° C. to 60° C. The water solvent was recovered from the reaction mixture by distillation at 93° C., after which, the solution was cooled to ambient temperature allowing for recovery of the water soluble scavenging compound.

Example 3

Synthesis of 1,3-Bis(methoxypropyl) Hydantoin

Hydantoin (41.03 g, 0.41 moles) was dissolved in 25 g of deionized water and 66.55 g (0.82 moles) of formalin at 52° C. The temperature of the mixture was increased to 70° C. and stirred for 2 hours to ensure all of the hydantoin was dissolved. After allowing the mixture to cool to 20° C., 1-propanol (49.53 g, 0.82 moles) was added dropwise into the reaction mixture over the course of 18 minutes. The stirring of the solution was continued and the temperature was slowly increased to 35° C. over a 30 minute period. The temperature of the reaction mixture was further increased to 60° C. and maintained for 2 hours. The water solvent was recovered from the reaction mixture by distillation at 90° C., after which, the solution was cooled to ambient temperature allowing for recovery of the water soluble scavenging compound.

Example 4

Performance Testing of Scavenging Compounds

To evaluate the scavenging properties of the compounds synthesized, each compound's scavenging efficiencies was investigated using the vapor phase "Can Test" method typically employed in the Petroleum and Refining Industry to determine $H_2S$ and mercaptan concentrations above a confined sour hydrocarbon before and after chemical addition. $H_2S$ detector tubes are available for a wide range of concentrations. Likewise, mercaptan detector tubes are designed to detect and measure methyl, ethyl and isopropyl mercaptans simultaneously without distinguishing among the mercaptans contaminating the odiferous hydrocarbon. Light Vacuum Naphtha (LVN) obtained from a Gulf Coast refinery known to be contaminated with mercaptans was utilized to evaluate both the 1,3-bis(methoxypropyl)-5,5-dimethyl hydantoin and 1,3-bis(methoxypropyl) hydantoin derivatives. Sour vacuum gas oil obtained from California's Santa Monica Bay area as well as vacuum tower bottoms collected from a Twin Cities Minnesota refinery known to be contaminated with hydrogen sulfide were utilized to determine the scavenging efficiencies of the oil soluble, 1,3-bis (dibutylaminomethyl)-5,5-dimethyl hydantoin derivatives.

Quart metal cans were filled with 500 mL of sour hydrocarbon media (e.g., LVN or kerosene) and quickly capped to ensure $H_2S$ or mercaptans did not escape. Each sample was heated for a predetermined time in a hot water bath approximating refinery process and storage temperatures when possible. After the heating cycle had elapsed, the can was shaken to ensure that volatile compounds were in the vapor space of each can, and the vapor headspace concentrations of mercaptans or hydrogen sulfide were determined using detector tubes for the appropriate analyte. Samples were treated with the scavenging compound of interest and then heated in the hot water bath for a second heating cycle for a specified residence time at a specified temperature. Once the second heating cycle had elapsed, reductions in hydrogen sulfide and/or mercaptan concentrations were determined. The method allowed for product evaluation and determination of scavenging efficiencies for each scavenging compound.

Light Vacuum Naphtha (LVN also known as IVN) is also known as Low Sulfur Naphtha and contains 30 to 40 ppm total mercaptan as measured using GasTech mercaptan detection tubes. Gas Tech detection tube 70 is capable of detecting methyl, ethyl, and isopropyl mercaptans. LVN was characterized using ASTM D 5623 GC-Chemiluminescence. Mercaptan scavenger candidates must overcome a variety of low and heavy sulfur compounds to abate contaminating mercaptans, or at the very least, reduce the odor attributed to the various sulfur compounds contaminating the stream.

EC5010A (available from Nalco Champion) is a commercial mercaptan scavenger. The reaction ratio is the concentration in ppm of the scavenging compound required to react with 1 ppm of mercaptan (RSH).

A three hour residence time after addition of the scavenging compounds to LVN while maintaining the temperature at 85° F. (29.4° C.) was used to test the compounds as reported in Table 1.

TABLE 1

| Sample No. | Treatment | Dosage | Initial RSH Conc., ppm | Final RSH Conc., ppm | Amount Consumed | Percent Reduced | Reaction Ratio |
|---|---|---|---|---|---|---|---|
| 1 | 1,3-bis (methoxypropyl)-5,5-dimethyl hydantoin | 80 | 40 | 22 | 18 | 45% | 4.44:1 |
| 2 | None | 0 | 20 | 20 | 0 | — | — |
| 3 | 1,3-bis (methoxypropyl) hydantoin | 80 | 40 | 42 | +2 | +5% | — |

A 2.5 hour residence time after addition of the scavenging compounds to LVN while maintaining the temperature at 85° F. (29.4° C.) was used to compare the test results of 1,3-bis(methoxypropyl)-5,5-dimethyl hydantoin to EC5010A as reported in Table 2.

TABLE 2

| Sample No. | Treatment | Dosage | Initial RSH Conc., ppm | Final RSH Conc., ppm | Amount Consumed | Percent Reduced | Reaction Ratio |
|---|---|---|---|---|---|---|---|
| 1 | Blank | 0 | 30 | 30 | 0 | 0% | — |
| 2 | 1,3-bis (methoxypropyl)-5,5-dimethyl hydantoin | 66 | 30 | 30 | 0 | 0% | — |
| 3 | 1,3-bis (methoxypropyl)-5,5-dimethyl hydantoin | 154 | 35 | 25 | 10 | 28.6% | 15.4:1 |
| 4 | 1,3-bis (methoxypropyl)-5,5-dimethyl hydantoin | 230 | 35 | 22 | 13 | 37.1% | 17.1:1 |
| 5 | EC5010A | 66 | 30 | 30 | 0 | 0% | — |
| 6 | EC5010A | 198 | 30 | 28 | 2 | 6.7% | 99.0:1 |
| 7 | EC5010A | 230 | 35 | 25 | 10 | 28.6% | 23.0:1 |

A two hour residence time after addition of the scavenging compounds to sour kerosene while maintaining the temperature at 85° F. (29.4° C.) was used to compare the hydrogen sulfide scavenging test results of 1,3-bis(methoxypropyl)-5,5-dimethyl hydantoin and 1,3-bis(methoxypropyl) hydantoin to EC9085A as reported in Table 3. Samples were treated at a reaction ratio of 0.40 ppm scavenger per 1 ppm detected in the vapor space of each sample. The Nalco Champion SULFA-CHECK® EC9085A is available from Nalco Champion. The abbreviation ND means the hydrogen sulfide was Not Detected.

TABLE 3

| Sample No. | Treatment | Dosage | Initial RSH Conc., ppm | Final RSH Conc., ppm | Amount Consumed | Percent Reduced | Reaction Ratio |
|---|---|---|---|---|---|---|---|
| 1 | Blank | 0 | 1600 | 1390 | (210) | (13.1%) | — |
| 2 | 1,3-bis (methoxypropyl)-5,5-dimethyl hydantoin | 650 | 1625 | 60 | 1565 | 96.3% | 0.42:1 |
| 3 | 1,3-bis (methoxypropyl) hydantoin | 590 | 1475 | 90 | 1385 | 93.3% | 0.43:1 |
| 4 | EC9085A | 560 | 1400 | ND | 1400 | 100% | 0.40:1 |

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the methods without departing from the scope of the invention, it is intended that all matter contained in the above description and shown in the accompanying drawings shall be interpreted as illustrative and not in a limiting sense.

What is claimed is:

1. A method of reducing the amount of hydrogen sulfide or mercaptans in a hydrocarbon fluid comprising contacting the hydrocarbon fluid with an effective amount of a composition comprising a compound of formula 1 having the structure:

(1)

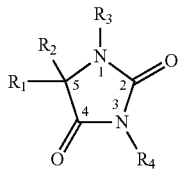

wherein $R_1$ and $R_2$ are independently hydrogen, alkyl, alkenyl, alkynyl, cycloalkyl, aryl, alkoxy or $R_1$ and $R_2$ together form $=CHR_5$; and $R_3$ and $R_4$ are independently hydrogen, alkyl, alkenyl, alkynyl, aryl, (cycloalkyl)alkyl, [(cycloalkyl)alkoxy]alkyl, (heterocycloalkyl)alkyl, [(heterocycloalkyl)alkoxy]alkyl, (alkylamino)alkyl, (dialkylamino)alkyl, (cycloalkylamino)alkyl, (dicycloalkylamino)alkyl, (arylamino)alkyl, (diarylamino)alkyl, (heteroarylamino)alkyl, (diheteroarylamino)alkyl, alkoxyalkyl, alkenoxyalkyl, or alkynoxyalkyl;

$R_5$ is hydrogen, alkyl, alkenylaryl, phenyl, furyl, pyrrolyl, pyridyl, or indolyl;

wherein at least one of $R_3$ and $R_4$ is other than hydrogen.

2. The method of claim 1, wherein $R_1$ and $R_2$ are independently hydrogen, $C_1$-$C_6$ alkyl, $C_2$-$C_6$ alkenyl, $C_2$-$C_6$ alkynyl, $C_3$-$C_6$ cycloalkyl, phenyl, tolyl, xylyl, naphthyl, or $C_1$-$C_6$ alkoxy.

3. The method of claim 2, wherein $R_1$ and $R_2$ are independently hydrogen or $C_1$-$C_6$ alkyl.

4. The method of claim 3, wherein $R_1$ and $R_2$ are independently hydrogen or methyl.

5. The method of claim 1, wherein at least one of $R_3$ and $R_4$ is alkyl, alkenyl, alkynyl, aryl, (alkylamino)alkyl, (dialkylamino)alkyl, alkoxyalkyl, alkenoxyalkyl, alkynoxyalkyl, (arylamino)alkyl, or (diarylamino)alkyl, wherein alkyl is $C_1$-$C_6$ alkyl, alkenyl is $C_2$-$C_6$ alkenyl, alkynyl is $C_2$-$C_6$ alkynyl, alkoxy is $C_1$-$C_6$ alkoxy, alkenoxy is $C_2$-$C_6$ alkenoxy, alkynoxy is $C_2$-$C_6$ alkynoxy, and aryl is phenyl, tolyl, xylyl, or naphthyl.

6. The method of claim 1, wherein at least one of $R_3$ and $R_4$ is (cycloalkyl)alkyl, [(cycloalkyl)alkoxy]alkyl, (cycloalkylamino)alkyl, or (dicycloalkylamino)alkyl, wherein alkyl is $C_1$-$C_6$ alkyl, alkoxy is $C_1$-$C_6$ alkoxy, and cycloalkyl is $C_3$-$C_6$ alkyl.

7. The method of claim 1, wherein at least one of $R_3$ and $R_4$ is (heterocycloalkyl)alkyl or [(heterocycloalkyl)alkoxy]alkyl, wherein heterocycloalkyl is oxiranyl, aziridinyl, oxetanyl, tetrahydrofuranyl, pyrrolidinyl, piperidinyl, dioxanyl, or morpholino, alkyl is $C_1$-$C_6$ alkyl, and alkoxy is $C_1$-$C_6$ alkoxy.

8. The method of claim 1, wherein at least one of $R_3$ and $R_4$ is (heteroarylamino)alkyl or (diheteroarylamino)alkyl, wherein heteroaryl is furanyl, pyrrolyl, pyranyl, pyridinyl, imidazolyl, pyrimidinyl, isoxazolyl, or oxazolyl, and alkyl is $C_1$-$C_6$ alkyl.

9. The method of claim 1, wherein the hydrocarbon fluid is a liquid.

10. The method of claim 9, wherein the liquid is crude oil, field oil, asphalt, fuel oil, naphtha, gasoline, kerosene, diesel, slurry oil, gas oil, resid, or a combination thereof.

11. The method of claim 10, wherein the liquid is crude oil.

12. The method of claim 1, wherein the effective amount of the compound is from 0.1 to 10,000 ppm in the hydrocarbon fluid.

13. The method of claim 12, wherein the effective amount of the compound is from 1 to 10,000 ppm in the hydrocarbon fluid.

14. The method of claim 1, further comprising storing the hydrocarbon fluid in a storage tank, rail car, tank truck, or pipeline after it is contacted with the composition.

15. The method of claim 14, wherein the hydrocarbon fluid is stored in a storage tank.

16. The method of claim 1, wherein the composition is contacted with the hydrocarbon fluid by injecting the composition into a run-down line for the hydrocarbon fluid.

17. The method of claim 1, wherein the composition is contacted with the hydrocarbon fluid by injecting the composition into a storage tank with mixing.

18. The method of claim 1, wherein the composition further comprises methanol, heavy aromatic naphtha, light aromatic naphtha, 2-ethylhexanol, or a combination thereof.

19. The method of claim 11, wherein the compound of Formula 1 is 1,3-bis(alkoxyalkyl)-5,5-dialkyl-hydantoin or 1,3-bis(alkoxyalkyl)hydantoin.

20. A method of reducing the amount of hydrogen sulfide or mercaptans in a hydrocarbon fluid comprising contacting the hydrocarbon fluid with an effective amount of a composition comprising a compound, wherein the compound is a 1-[(oxiranylalkoxy)alkyl]hydantoin, 3-[(oxiranylalkoxy)alkyl]hydantoin, 1,3-bis[(oxiranylalkoxy)alkyl]hydantoin, 1-[(oxiranylalkoxy)alkyl]-5,5-dialkyl-hydantoin, 3-[(oxiranylalkoxy)alkyl]-5,5-dialkyl-hydantoin, 1,3-bis[(oxiranylalkoxy)alkyl]-5,5-dialkyl-hydantoin, 1-(dibutylaminoalkyl)hydantoin, 3-(dibutylaminoalkyl)hydantoin, 1,3-bis(dibutylaminoalkyl)hydantoin, 1-(dibutylaminoalkyl)-5,5-dialkyl-hydantoin, 3-(dibutylaminoalkyl)-5,5-dialkyl-hydantoin, 1,3-bis(dibutylaminoalkyl)-5,5-dialkyl-hydantoin, 1-(anilinoalkyl)hydantoin, 3-(anilinoalkyl)hydantoin, 1,3-bis(anilinoalkyl)hydantoin, 1-(anilinoalkyl)-5,5-dialkyl-hydantoin, 3-(anilinoalkyl)-5,5-dialkyl-hydantoin, 1,3-bis(anilinoalkyl)-5,5-dialkyl-hydantoin, 1-(morpholinoalkyl)hydantoin, 3-(morpholinoalkyl)hydantoin, 1,3-bis(morpholinoalkyl)hydantoin, 1-(morpholinoalkyl)-5,5-dialkyl-hydantoin, 3-(morpholinoalkyl)-5,5-dialkyl-hydantoin, 1,3-bis(morpholinoalkyl)-5,5-dialkyl-hydantoin, 1-(oxiranylalkyl)hydantoin, 3-(oxiranylalkyl)hydantoin, 1,3-bis(oxiranylalkyl)hydantoin, 1-(oxiranylalkyl)-5,5-dialkyl-hydantoin, 3-(oxiranylalkyl)-5,5-dialkyl-hydantoin, 1,3-bis(oxiranylalkyl)-5,5-dialkyl-hydantoin, 1-(alkoxyalkyl)hydantoin, 3-(alkoxyalkyl)hydantoin, 1,3-bis(alkoxyalkyl)hydantoin, 1-(alkoxyalkyl)-5,5-dialkyl-hydantoin, 3-(alkoxyalkyl)-5,5-dialkyl-hydantoin, 1,3-bis(alkoxyalkyl)-5,5-dialkyl-hydantoin, 1-(allyloxyalkyl)hydantoin, 3-(allyloxyalkyl)hydantoin, 1,3-bis(allyloxyalkyl)hydantoin, 1-(allyloxyalkyl)-5,5-dialkyl-hydantoin, 3-(allyloxyalkyl)-5,5-dialkyl-hydantoin, 1,3-bis(allyloxyalkyl)-5,5-dialkyl-hydantoin, 1-(propargyloxyalkyl)hydantoin, 3-(propargyloxyalkyl)hydantoin, 1,3-bis(propargyloxyalkyl)hydantoin, 1-(propargyloxyalkyl)-5,5-dialkyl-hydantoin, 3-(propargyloxyalkyl)-5,5-dialkyl-hydantoin, or 1,3-bis(propargyloxyalkyl)-5,5-dialkyl-hydantoin.

21. The method of claim 20, wherein the compound is 1-[(oxiranylmethoxy)methyl]hydantoin, 3-[(oxiranylmethoxy)methyl]hydantoin, 1,3-bis[(oxiranylmethoxy)methyl]hydantoin, 1-[(oxiranylmethoxy)methyl]-5,5-dimethyl-hydantoin, 3-[(oxiranylmethoxy)methyl]-5,5-dimethyl-hydantoin, 1,3-bis[(oxiranylmethoxy)methyl]-5,5-dimethyl-hydantoin, 1-(dibutylaminomethyl)hydantoin, 3-(dibutylaminomethyl)hydantoin, 1,3-bis(dibutylaminomethyl)hydantoin, 1-(dibutylaminomethyl)-5,5-dimethyl-hydantoin, 3-(dibutylaminomethyl)-5,5-dimethyl-hydantoin, 1,3-bis(dibutylaminomethyl)-5,5-dimethyl-hydantoin, 1-(anilinomethyl)hydantoin, 3-(anilinomethyl)hydantoin, 1,3-bis(anilinomethyl)hydantoin, 1-(anilinomethyl)-5,5-dimethyl-hydantoin, 3-(anilinomethyl)-5,5-dimethyl-hydantoin, 1,3-bis(anilinomethyl)-5,5-dimethyl-hydantoin, 1-(morpholinomethyl)hydantoin, 3-(morpholinomethyl)hydantoin, 1,3-bis(morpholinomethyl)hydantoin, 1-(morpholinomethyl)-5,5-dimethyl-hydantoin, 3-(morpholinomethyl)-5,5-dimethyl-hydantoin, 1,3-bis(morpholinomethyl)-5,5-dimethyl-hydantoin, 1-(oxiranylmethyl)hydantoin, 3-(oxiranylmethyl)hydantoin, 1,3-bis(oxiranylmethyl)hydantoin, 1-(oxiranylmethyl)-5,5-dimethyl-hydantoin, 3-(oxiranylmethyl)-5,5-dimethyl-hydantoin, 1,3-bis(oxiranylmethyl)-5,5-dimethyl-hydantoin, 1-(methoxymethyl)hydantoin, 3-(methoxymethyl)hydantoin, 1,3-bis(methoxymethyl)hydantoin, 1-(methoxymethyl)-5,5-dimethyl-hydantoin, 3-(methoxymethyl)-5,5-dimethyl-hydantoin, 1,3-bis(methoxymethyl)-5,5-dimethyl-hydantoin, 1-(ethoxymethyl)hydantoin, 3-(ethoxymethyl)hydantoin, 1,3-bis(ethoxymethyl)hydantoin, 1-(ethoxymethyl)-5,5-dimethyl-hydantoin, 3-(ethoxymethyl)-5,5-dimethyl-hydantoin, 1,3-bis(ethoxymethyl)-5,5-dimethyl-hydantoin, 1-(propoxymethyl)hydantoin, 3-(propoxymethyl)hydantoin, 1,3-bis(propoxymethyl)hydantoin, 1-(propoxymethyl)-5,5-dimethyl-hydantoin, 3-(propoxymethyl)-5,5-dimethyl-hydantoin, 1,3-bis(propoxymethyl)-5,5-dimethyl-hydantoin, 1-(allyloxymethyl)hydantoin, 3-(allyloxymethyl)hydantoin, 1,3-bis(allyloxymethyl)hydantoin, 1-(allyloxymethyl)-5,5-dimethyl-hydantoin, 3-(allyloxymethyl)-5,5-dimethyl-hydantoin, 1,3-bis(allyloxymethyl)-5,5-dimethyl-hydantoin, 1-(propargyloxymethyl)hydantoin, 3-(propargyloxymethyl)hydantoin, 1,3-bis(propargyloxymethyl)hydantoin, 1-(propargyloxymethyl)-5,5-dimethyl-hydantoin 3-(propargyloxymethyl)-5,5-dimethyl-hydantoin, or 1,3-bis(propargyloxymethyl)-5,5-dimethyl-hydantoin.

* * * * *